US005135713A

United States Patent [19]

Rioja et al.

[11] Patent Number: 5,135,713

[45] Date of Patent: * Aug. 4, 1992

[54] ALUMINUM-LITHIUM ALLOYS HAVING HIGH ZINC

[75] Inventors: Roberto J. Rioja, Lower Burrell; James T. Staley, Murrysville, both of Pa.

[73] Assignee: Aluminum Company of America, Pittsburgh, Pa.

[ * ] Notice: The portion of the term of this patent subsequent to Mar. 10, 2004 has been disclaimed.

[21] Appl. No.: 588,410

[22] Filed: Sep. 26, 1990

Related U.S. Application Data

[63] Continuation-in-part of Ser. No. 149,802, Jan. 28, 1988, and Ser. No. 172,506, Mar. 24, 1988, Pat. No. 4,961,792, which is a continuation-in-part of Ser. No. 685,731, Dec. 24, 1984, Pat. No. 4,797,165, which is a continuation-in-part of Ser. No. 594,344, Mar. 19, 1984, Pat. No. 4,648,913.

[51] Int. Cl.[5] ..... C22C 21/06

[52] U.S. Cl. ..... 420/532; 148/417; 148/418; 148/439; 420/535; 420/539

[58] Field of Search ..... 420/532, 534, 535, 539, 420/541, 542, 543; 148/439, 417, 418

[56] References Cited

U.S. PATENT DOCUMENTS 4,869,870 9/1989 Rioja et al. ..... 420/532
4,961,792 10/1990 Rioja et al. ..... 148/417

FOREIGN PATENT DOCUMENTS 0057049 3/1969 Poland ..... 420/541

OTHER PUBLICATIONS

Baba Yoshios: "Effects of Additional Elements and Heat Treatments on the Fracture Characteristics of Al-Zn-Mg Alloy,", *J. Japan Inst. Metals* (Trans. JIM): 1970, vol. 11, No. 6, pp. 404–410.

*Primary Examiner*—B. Dean
*Assistant Examiner*—Robert R. Koehler
*Attorney, Agent, or Firm*—Andrew Alexander

[57] ABSTRACT

An aluminum base alloy suitable for forming into a wrought product having improved combinations of strength and fracture toughness is disclosed. The product is comprised of 0.2 to 3.0 wt. % Li, 0.1 to 3 wt. % Mg, 0.2 to 3 wt. % Cu, 5.1 to 12 wt. % Zn, 0.5 wt. % max. Fe, 0.5 wt. % max. Si, at least one of the elements selected from the group Cr, V, Hf, Mn, Ti, Ag, In and Zr, with Cr, V, Ti and Zr in the range of 0.01 to 0.2 wt. %; Hf and Mn up to 0.6 wt. % each, Ag in the range of 0.05 to 1 wt. % and in the range of 0.01 to 0.5 wt. %, the balance aluminum and incidental impurities.

14 Claims, 2 Drawing Sheets

ISOSPECIFIC TENSILE YIELD STRENGTH CONTOURS FOR Al-Zn-Mg-1.5% Cu ALLOYS IN A T6 TEMPER

Al-Zn-Mg-Cu-Li ALLOY
AGING RESPONSE

ISOSPECIFIC TENSILE YIELD STRENGTH CONTOURS FOR Al-Zn-Mg-1.5% Cu ALLOYS IN A T6 TEMPER

ALUMINUM-LITHIUM ALLOYS HAVING HIGH ZINC

CROSS REFERENCE TO RELATED APPLICATIONS

This is a continuation-in-part of U.S. Pat. application Ser. No. 149,802, filed Jan. 28, 1988 and U.S. Pat. application Ser. No. 172,506, filed Mar. 24, 1988, now U.S. Pat. No. 4,961,792, issued Oct. 9, 1990, is a continuation-in-part of U.S. Pat. application Ser. No. 685,731, filed Dec. 24, 1984, now U.S. Pat. No. 4,797,165, issued Jan. 10, 1989, which is a continuation-in-part of U.S. Serial No. 594,344, filed March 29, 1984, now U.S. Patent 4,648,913, issued March 10, 1987.

BACKGROUND OF THE INVENTION

This invention relates to aluminum base alloy products, and more particularly, it relates to improved lithium containing aluminum base alloy products having improved corrosion resistance and a method of producing the same.

In the aircraft industry, it has been generally recognized that one of the most effective ways to reduce the weight of an aircraft is to reduce the density of aluminum alloys used in the aircraft construction. For purposes of reducing the alloy density, lithium additions have been made. However, the addition of lithium to aluminum alloys is not without problems. For example, the addition of lithium to aluminum alloys often results in a decrease in ductility and fracture toughness. Where the use is in aircraft parts, it is imperative that the lithium containing alloy have both improved fracture toughness and strength properties.

It will be appreciated that both high strength and high fracture toughness appear to be quite difficult to obtain when viewed in light of conventional alloys such as AA (Aluminum Association) 2024-T3X and 7050-TX normally used in aircraft applications. For example, a paper by J. T. Staley entitled "Microstructure and Toughness of High-Strength Aluminum Alloys", Properties Related to Fracture Toughness, ASTM STP605, American Society for Testing and Materials, 1976, pp. 71–103, shows generally that for AA2024 sheet, toughness decreases as strength increases. Also, in the same paper, it will be observed that the same is true of AA7050 plate. More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys would find widespread use in the aerospace industry where low weight and high strength and toughness translate to high fuel savings. Thus, it will be appreciated that obtaining qualities such as high strength at little or no sacrifice in toughness, or where toughness can be controlled as the strength is increased would result in a remarkably unique aluminum-lithium alloy product.

The present invention provides an improved lithium containing aluminum base alloy product which can be processed to improve strength characteristics while retaining high toughness properties or which can be processed to provide a desired strength at a controlled level of toughness.

SUMMARY OF THE INVENTION

A principal object of this invention is to provide a lithium containing aluminum base alloy product.

Another object of this invention is to provide an improved aluminum-lithium alloy wrought product having improved strength and toughness characteristics.

Yet another object of this invention is to provide an Aluminum Association 7000-type aluminum alloy containing lithium having improved properties.

And yet another object of this invention includes a method of providing a wrought aluminum-lithium alloy product having improved corrosion resistance and working the product after solution heat treating to increase strength properties without substantially impairing its fracture toughness.

And yet a further object of this invention is to provide a method of increasing the strength of a wrought aluminum-lithium alloy product after solution heat treating without substantially decreasing fracture toughness.

These and other objects will become apparent from the specification, drawings and claims appended hereto.

An aluminum base alloy suitable for forming into a wrought product having improved combinations of strength and fracture toughness is disclosed. The product is comprised of 0.2 to 3.0 wt.% Li, 0.5 to 3 wt.% Mg, 0.2 to 3 wt.% Cu, 5.1 to 12 wt.% Zn, 0.5 wt.% max. Fe, 0.5 wt.% max. Si, at least one of the elements selected from the group Cr, V, Hf, Mn, Ti, Ag, In and Zr, with Cr, V, Ti and Zr in the range of 0.01 to 0.2 wt.%; Hf and Mn up to 0.6 wt.% each, Ag in the range of 0.05 to 1 wt.% and In in the range of 0.01 to 0.5 wt.%, the balance aluminum and incidental impurities.

The product is capable of having imparted thereto a working effect equivalent to stretching so that the product has combinations of improved strength and fracture toughness after aging. In the method of making an aluminum base alloy product having improved combinations of strength, fracture toughness and corrosion resistance, a body of a lithium containing aluminum base alloy is provided and may be worked to produce a wrought aluminum product. The wrought product may be first solution heat treated and then stretched or otherwise worked amount equivalent to stretching. The degree of working as by stretching, for example, is normally greater than that used for relief of residual internal quenching stresses.

DETAILED DESCRIPTION OF THE PREFERRED EMBODIMENTS

Figure 1:
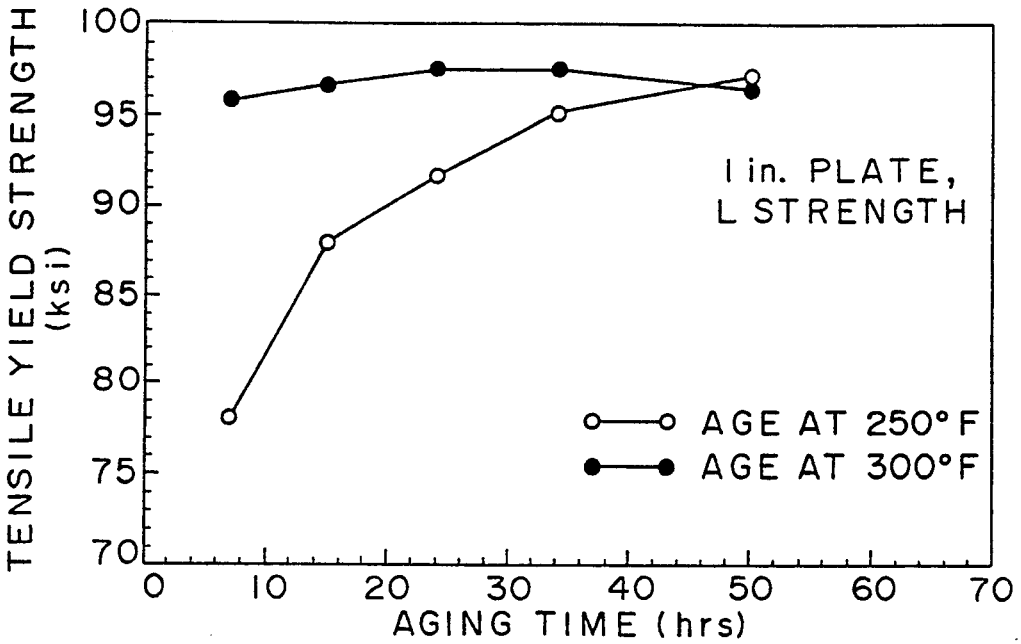
FIG. 1 is a graph showing tensile yield strength versus aging time at 250° F. and 300° F.

The alloy of the present invention can contain 0.2 to 5.0 wt.% Li, 0 to 5.0 wt.% Mg, up to 5.0 wt.% Cu, 0 to 1.0 wt.% Zr, preferably up to 0.5 wt.% Zr, 0 to 2.0 wt.% Mn, 0.05 to 12.0 wt.% Zn, 0.5 wt.% max. Fe, 0.5 wt.% max. Si, the balance aluminum and incidental impurities. The impurities are preferably limited to about 0.05 wt.% each, and the combination of impurities preferably should not exceed 0.15 wt.%. Within these limits, it is preferred that the sum total of all impurities does not exceed 0.35 wt.%.

An alloy in accordance with the present invention can contain 0.2 to 5.0 wt.% Li, at least 2.45 wt.% Cu, 0.05 to 5.0 wt.% Mg, 0.05 to 0.16 wt.% Zr, 0.05 to 12.0 wt.% Zn, the balance aluminum and impurities as specified above. A further alloy composition would contain 0.5 to 2.0 wt.% Li, 2.55 to 2.90 wt.% Cu, 0.2 to 2.5 wt.% Mg, 0.2 to 11.0 wt.% Zn, 0.08 to 0.12 wt.% Zr, 0 to 1.0 wt.% Mn and max. 0.1 wt.% of each of Fe and Si. In a preferred typical alloy, Zn may be in the range of 0.2 to 2.0 and Mg 0.2 to 2.0 wt.%.

In another aspect of the invention, the alloy can be comprised of 0.2 to 3.0 wt.% Li, 0.5 to 3 wt.% Mg, 0.05 to 3 wt.% Cu, 5.1 to 12 wt.% Zn, 0.5 wt.% max. Fe, 0.5 wt.% max. Si, at least one of the elements selected from the group Cr, V, Hf, Mn, Ti, Ag, In and Zr, with Cr, V, Ti and Zr in the range of 0.01 to 0.2 wt.%; Hf and Mn up to 0.6 wt.% each, Ag in the range of 0.05 to 1 wt.% and In in the range of 0.01 to 0.5 wt.%, the balance aluminum and incidental impurities. Copper can range from 0.2 to 2.44 wt.% with suitable amounts being 0.2 to 2.0 wt.%.

In the present invention, lithium is very important not only because it permits a significant decrease in density but also because it improves tensile and yield strengths markedly as well as improving elastic modulus. Additionally, the presence of lithium improves fatigue resistance. Most significantly though, the presence of lithium in combination with other controlled amounts of alloying elements permits aluminum alloy products which can be worked to provide unique combinations of strength and fracture toughness while maintaining meaningful reductions in density. It will be appreciated that less than 0.5 wt.% Li does not provide for significant reductions in the density of the alloy. It is not presently expected that higher levels of lithium would improve the combination of toughness and strength of the alloy product.

It must be recognized that to obtain a high level of corrosion resistance in addition to the unique combinations of strength and fracture toughness as well as reductions in density requires careful selection of all the alloying elements. For example, for every 1 wt.% Li added, the density of the alloy is decreased about 2.4%. Thus, if density is the only consideration, then the amount of Li would be maximized. However, if it is desired to increase toughness at a given strength level, then Cu should be added. However, for every 1 wt.% Cu added to the alloy, the density is increased by 0.87% and resistance to corrosion. Likewise, for every 1 wt.% Mn added, the density is increased about 0.85%. Thus, care must be taken to avoid losing the benefits of lithium by the addition of alloying elements such as Cu and Mn, for example. Accordingly, while lithium is the most important element for saving weight, the other elements are important in order to provide the proper levels of strength, fracture toughness, corrosion and stress corrosion cracking resistance.

With respect to copper, particularly in the ranges set forth hereinabove for use in accordance with the present invention, its presence enhances the properties of the alloy product by reducing the loss in fracture toughness at higher strength levels. That is, as compared to lithium, for example, in the present invention copper has the capability of providing higher combinations of toughness and strength. For example, if more additions of lithium were used to increase strength without copper, the decrease in toughness would be greater than if copper additions were used to increase strength. Thus, in the present invention when selecting an alloy, it is important in making the selection to balance both the toughness and strength desired, since both elements work together to provide toughness and strength uniquely in accordance with the present invention. It is important that the ranges referred to hereinabove, be adhered to, particularly with respect to the upper limits of copper, since excessive amounts can lead to the undesirable formation of intermetallics which can interfere with fracture toughness. In addition, higher levels of copper can result in diminished resistance to corrosion. Typically, copper should be less than 3.0 wt.%; however, copper can be increased to less than 5 wt.% and preferably less than 4 wt.% and typically less than 3.5 wt.%. The combination of lithium and copper should not exceed 5.5 wt.% with lithium being at least 0.5 wt.% with greater amounts of lithium being preferred. Thus, in accordance with this invention, it has been discovered that adhering to the ranges set forth above for copper, fracture toughness, strength, corrosion and stress corrosion cracking can be maximized.

Magnesium is added or provided in this class of aluminum alloys mainly for purposes of increasing strength although it does decrease density slightly and is advantageous from that standpoint. It is important to adhere to the upper limits set forth for magnesium because excess magnesium can also lead to interference with fracture toughness, particularly through the formation of undesirable phases at grain boundaries.

Zirconium may be added for grain structure control; however, other elements which may control grain structure or improve strength can include Cr, V, Hf, Mn, Sc, Ti, Ag and In, with Cr, V, Mn and Ti being in the range of 0.05 to 0.2 wt.% with Hf and Mn up to typically 0.6 wt.%, Ag in the range of 0.05 to 1 wt.% and In in the range of 0.01 to 0.5 wt.%. The level of Zr, Hf or Sc used depends on whether a recrystallized or unrecrystallized structure is desired. The use of zinc results in increased levels of strength, particularly in combination with magnesium. However, excessive amounts of zinc can impair toughness through the formation of intermetallic phases.

Zinc is important because, in this combination with magnesium, it results in an improved level of strength. In a preferred aspect, Zn can range from 5.1 to 11 wt.%, preferably 5.2 to 10 wt.% with typical amounts being in the range of 7.1 to 11 wt.% and suitable amounts being 7.2 or 7.5 to 10 wt.%.

Toughness or fracture toughness as used herein refers to the resistance of a body, e.g. sheet or plate, to the unstable growth of cracks or other flaws.

As well as providing the alloy product with controlled amounts of alloying elements as described hereinabove, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products, with continuous casting being preferred. Further, the alloy may be roll cast or slab cast to thicknesses from about ¼ to 2 or 3 inches or more depending on the end product desired. It should be noted that the alloy may also be provided in billet form consolidated from fine particulate such as powdered aluminum alloy having the compositions in the ranges set forth hereinabove. The powder or particulate material can be produced by processes such as atomization, mechanical alloying and melt spinning. The ingot or billet may be preliminarily worked or shaped to provide suitable stock for subsequent working operations. Prior to the principal working operation, the alloy stock is preferably subjected to homogenization, and preferably at metal temperatures in the range of 860 to 1050° F. for a period of time of at least one hour to dissolve soluble elements such as Li and Cu, and to homogenize the internal structure of the metal. A preferred time period is about 20 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable. In addition to dissolving constituent to promote workability, this homogenization treatment is important in that it is believed to precipitate the Mn and Zr-bearing dispersoids which help to control final grain structure.

After the homogenizing treatment, the metal can be rolled or extruded or otherwise subjected to working operations to produce stock such as sheet, plate or extrusions or other stock suitable for shaping into the end product. To produce a sheet or plate-type product, a body of the alloy is preferably hot rolled to a thickness ranging from 0.1 to 0.25 inch for sheet and 0.25 to 6.0 inches for plate. For hot rolling purposes, the temperature should be in the range of 950° F. down to 550° F. Preferably, the metal temperature initially is in the range of 850 to 750° F.

When the intended use of a plate product is for wing spars where thicker sections are used, normally operations other than hot rolling are unnecessary. Where the intended use is wing or body panels requiring a thinner gauge, further reductions as by cold rolling can be provided. Such reductions can be to a sheet thickness ranging, for example, from 0.010 to 0.249 inch and usually from 0.030 to 0.25 inch.

After rolling a body of the alloy to the desired thickness, the sheet or plate or other worked article is subjected to a solution heat treatment to dissolve soluble elements. The solution heat treatment is preferably accomplished at a temperature in the range of 850 to 1050° F. and preferably produces an unrecrystallized grain structure.

Solution heat treatment can be performed in batches or continuously, and the time for treatment can vary from hours for batch operations down to as little as a few seconds for continuous operations. Basically, solution effects can occur fairly rapidly, for instance in as little as 30 to 60 seconds, once the metal has reached a solution temperature of about 850 to 1050° F. However, heating the metal to that temperature can involve substantial amounts of time depending on the type of operation involved. In batch treating a sheet product in a production plant, the sheet is treated in a furnace load and an amount of time can be required to bring the entire load to solution temperature, and accordingly, solution heat treating can consume one or more hours, for instance one or two hours or more in batch solution treating. In continuous treating, the sheet is passed continuously as a single web through an elongated furnace which greatly increases the heat-up rate. The continuous approach is favored in practicing the invention, especially for sheet products, since a relatively rapid heat up and short dwell time at solution temperature is obtained. Accordingly, the inventors contemplate solution heat treating in as little as about 1.0 minute. As a further aid to achieving a short heat-up time, a furnace temperature or a furnace zone temperature significantly above the desired metal temperature provides a greater temperature head useful in reducing heat-up times. However, when an unrecrystallized microstructure is required, a recovery annealing practice will be required prior to solution heat treatment.

To further provide for the desired strength and fracture toughness, as well as corrosion resistance, necessary to the final product and to the operations in forming that product, the product should be rapidly quenched to prevent or minimize uncontrolled precipitation of strengthening phases referred to herein later.

After the alloy product of the present invention has been quenched and worked, if desired, it may be artificially aged to provide the combination of fracture toughness and strength which are so highly desired in aircraft members. This can be accomplished by subjecting the sheet or plate or shaped product to a temperature in the range of 150 to 400° F. for a sufficient period of time to further increase the yield strength. Some compositions of the alloy product are capable of being artificially aged to a yield strength higher than 100 ksi. However, the useful strengths are in the range of 50 to 95 ksi and corresponding fracture toughnesses are in the range of 20 to 75 ksi vin. Preferably, artificial aging is accomplished by subjecting the alloy product to a temperature in the range of 200 to 375° F. for a period of at least 30 minutes. A suitable aging practice contemplate a treatment of about 8 to 48 hours at a temperature of about 250° F. Further, it will be noted that the alloy product in accordance with the present invention may be subjected to any of the typical underaging and overaging treatments well known in the art, including natural aging. Also, while reference has been made herein to single aging steps, multiple aging steps, such as two or three aging steps, are contemplated and stretching or its equivalent working may be used prior to or even after part of such multiple aging steps.

The product may be subjected to three aging steps, phases or treatments, although clear lines of demarcation may not exist between each step or phase. Ramping up to and/or down from given (or target) treatment temperatures, in itself, can produce precipitation (aging) effects which can, and often need to be, taken into account by integrating such ramping conditions, and their precipitation-hardening effects, into the total aging treatment program. With ramping and its corresponding integration, the three phases for thermally treating invention alloy according to this aging practice may be effected in a single, programmable furnace. For convenience purposes, though, each stage (step or phase) will be more fully described as a distinct operation hereafter. It is believed that the first stage serves to precipitation harden the alloy product, the second (higher temperature) stage then exposes alloy product to one or more elevated temperatures for increasing its resistance to exfoliation and stress corrosion cracking (SCC), while the third stage further precipitation hardens the invention alloy to a very high strength level.

In the first treatment stage, the alloy of the invention is precipitation hardened to strengthen it, for example, to a point at or near peak strength (whether underaged or slightly overaged) although less than peak strength conditions (or underaging) may be desired in some cases. Such precipitation hardening can be accomplished by heating to one or more elevated temperatures below about 300° F, preferably between about 200 and 300° F., for a period of time ranging from about 5 or 10 hours to about 40 hours or more. A substantially similar treatment may occur through gradual ramping to the second (higher temperature) treatment stage, with or without any hold time at temperatures in said first range.

This first treatment phase can also extend until the alloy achieves up to about 95% of peak strength (underaged), peak strength itself, or even until alloy strength runs slightly past peak and back down to about 95% of peak strength (through overaging). It should be understood, however, that for some embodiments, relative yield strengths may also increase during the second treatment phase depending on the extent to which peak yield strength was approached during the first treatment phase.

Following this first phase of thermal treatment, the alloy of the invention is preferably subjected to heating at temperatures above about 400° F., preferably within the range of from about 350 to about 450° F., for a few minutes or more (e.g., for 3 or more minutes), preferably more than three minutes, to about 3 to 20 hours or more. Generally, alloy exposure temperatures vary inversely with duration such that shorter times are used at relatively higher temperatures, while longer times are more appropriate at the lower temperatures, below about 400° F. or so.

When heating alloy products to one or more temperatures for "x" minutes according to this preferred second treatment phase, it is to be understood that such treatment embraces heating to any number of temperatures within said range for a cumulative time "x" above the lowest temperature of said range. As such, heating for 5 or more minutes within about 350 to 450° F. does not require holding for 5 minutes at each or even any particular temperature within said range, but rather, that the cumulative time at all temperatures within 350 to 450° F. is 5 minutes or more.

The second phase treatment may be carried out by immersing the alloy products into a substantially hot liquid such as molten salt, hot oil or even molten metal. A furnace (hot air and/or other gases) may also be used depending on the size, shape and quantity of the product to be treated. In the alternative, a fluidized bed-type apparatus may be used, such an apparatus providing more rapid heating than a hot air furnace but slower, more uniform heating than a molten salt bath. Fluidized bed heat-ups are especially advantageous for presenting fewer environmental complications. Induction heaters may also be used for artificial aging according to the invention, for instance, in the second phase of this preferred method.

During the third phase of this preferred treatment method, the alloy product of the invention is subjected to one or more elevated temperatures up to about 300° F., preferably between about 150 and about 250° F., for about 2 to 30 hours or more. With such treatment, the invention alloy is able to achieve significantly higher strength levels than those attained by 7075 and other 7XXX aluminum alloy product counterparts. When aged to achieve corrosion properties comparable to those of T6-aged products, for example, having EXCO corrosion ratings of "EB" or better, the alloy products of the invention produces minimum yield strengths (compression and/or tension) at least about 15% greater than the minimum strengths for a similarly-sized, shaped and formed 7X50 alloy product aged to a T76 temper, and at least about 15% greater relative strength than a 7X50-T6 product.

Relative strength values for artificially aged alloy products of the invention will vary to some extent depending on their size, shape and method of manufacture. For example, improved plate products should consistently achieve strengths of about 90 to about 100 ksi with differing cross-sectional thicknesses.

Table I below shows the composition, density and modulus of an alloy fabricated into one-inch plate in accordance with this invention. The sample was solution heat treated at 950° F. and cold water quenched prior to the aging steps. Table II shows the tensile yield strength obtained after aging treatments at 250° F. and 300° F. Table III shows results from fracture toughness measurements with the toughness measured in accordance with ASTM Standard E561-86, the disclosure of which is fully incorporated by reference herein.

TABLE I

Al—Zn—Mg—Cu—Li Alloy
Measured Composition[1], Density and Modulus
SHT at 950° F. for 2 hours CWQ, Aged 30 hours at 250° F.

| Alloy ID Number | wt. % Zn | wt. % Mg | wt. % Cu | wt. % Li | wt. % Zr | wt. % Fe | wt. % Si | Density[2] | Modulus[3] |
|---|---|---|---|---|---|---|---|---|---|
| 606084 | 9.2 | 2.16 | 1.42 | 1.12 | 0.11 | 0.05 | 0.05 | 0.099 | 10.52 |

[1]chemical analyses were conducted by atomic absorption
[2]measured by water displacement
[3]determined in tension

TABLE II

Al—Zn—Mg—Cu—Li Alloy
Aging Response at 250° F. and 300° F.

| Alloy ID | Aged for 7 hrs. | | | Aged for 15 hrs. | | | Aged for 24 hrs. | | | Aged for 34 hrs. | | | Aged for 50 hrs. | | | Aging |
|---|---|---|---|---|---|---|---|---|---|---|---|---|---|---|---|---|
| Number | TYS | UTS | % El | TYS | UTS | % El | TYS | UTS | % El | TYS | UTS | % El | TYS | UTS | % El | Temp. |
| 606084 | 78.1 | 86.6 | 8.5 | 88.0 | 92.8 | 5.5 | 91.7 | 95.2 | 3.8 | 95.2 | 97.7 | 3.2 | 96.9 | 99.0 | 3.0 | 250° F. |

TABLE II-continued

| Al—Zn—Mg—Cu—Li Alloy Aging Response at 250° F. and 300° F. | | | | | | | | | | | | | | | | |
|---|---|---|---|---|---|---|---|---|---|---|---|---|---|---|---|---|
| Alloy ID | Aged for 7 hrs. | | | Aged for 15 hrs. | | | Aged for 24 hrs. | | | Aged for 34 hrs. | | | Aged for 50 hrs. | | | Aging |
| Number | TYS | UTS | % El | TYS | UTS | % El | TYS | UTS | % El | TYS | UTS | % El | TYS | UTS | % El | Temp. |
| 606084 | 95.7 | 97.6 | 2.2 | 96.6 | 98.4 | 1.8 | 97.4 | 99.4 | 2.0 | 97.4 | 98.9 | 1.5 | 96.3 | 97.8 | 1.5 | 300° F. |

Results are the average of duplicate testing in the longitudinal orientation.
TYS and UTS are in ksi.

TABLE III

| Al—Zn—Mg—Cu—Li Alloy Strength/Toughness Results and Specific Strength | | | |
|---|---|---|---|
| Alloy | Aging | TYS (ksi) | Toughness (ksi $\sqrt{\text{in.}}$) |
| 606084 | 7 hr/25° F. | 78.1 | 32.8 |
| | 24 hr/250° F. | 91.7 | 23.8 |
| | 50 hr/250° F. | 96.9 | 21.0 |

Specific strength at peak strength $= \frac{96.9}{0.099} = 0.979$ (ksi in$^3$/lb) $\times 10^6$ Specific strength of 7150-T6 $= \frac{81.5}{0.102} = (0.799$ ksi in$^3$/lb$) \times 10^6$ This implies a 22.5% advantage in specific strength over 7150-T6.

Figure 2:
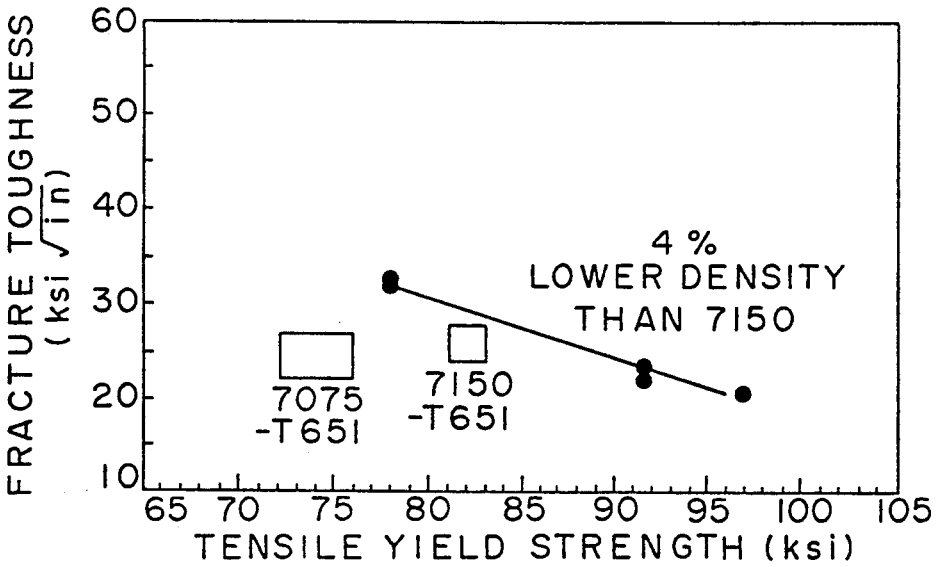
FIG. 2 is a graph plotting typical fracture toughness versus tensile yield strength for alloy products made in accordance with the invention, as well as for 7075-T651 and 7150-T651 alloy products.

The tensile yield strength and toughness values from Table III are shown plotted along the x and y axes, respectively, of accompanying FIG. 2.

FIG. 2 shows how the invention achieves greater combinations of these two main properties. That is, in FIG. 2, strength levels typically increase from left to right along the horizontal (or x-axis), while toughnesses increase from the bottom to top of the figure's y-axis, as illustrated. FIG. 2 shows that strength increases are typically traded for better toughness properties such that higher strengths may be achieved at lower toughnesses and vice versa.

Figure 3:
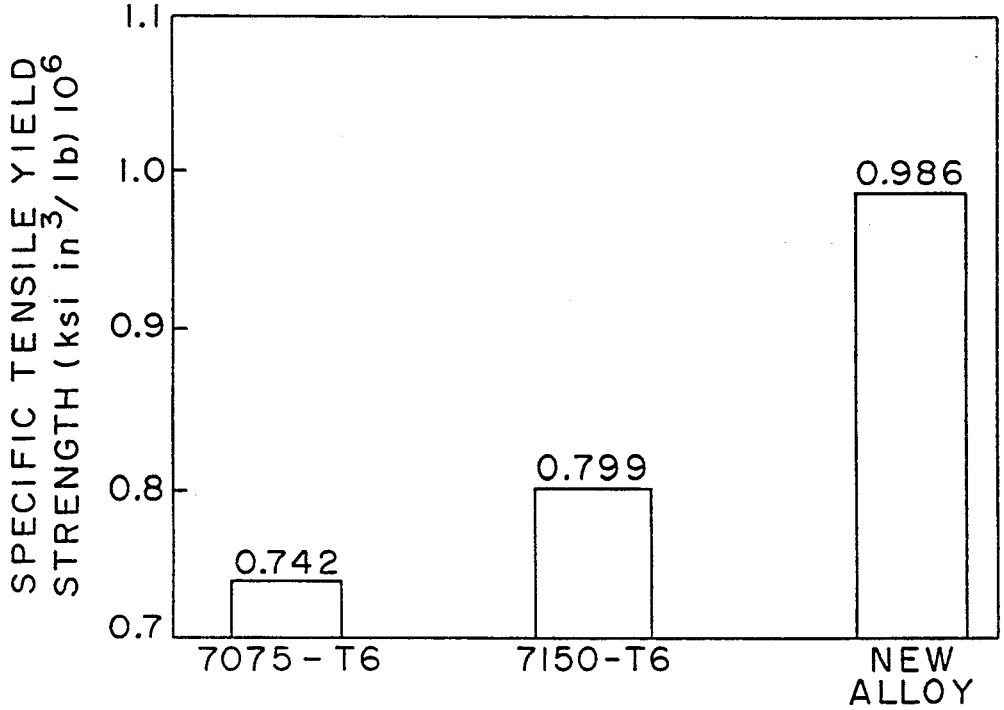
FIG. 3 is a bar graph plotting the specific strength of an alloy product of the invention versus the specific strength of alloy products made from 7075-T651 and 7150-T651 alloys.

In FIG. 3, the specific strength (tensile yield strength divided by density) of Sample 606084 is shown plotted against the specific strengths of similar alloy products of 7075-T6 alloy and 7150-T6 alloy.

Figure 4:
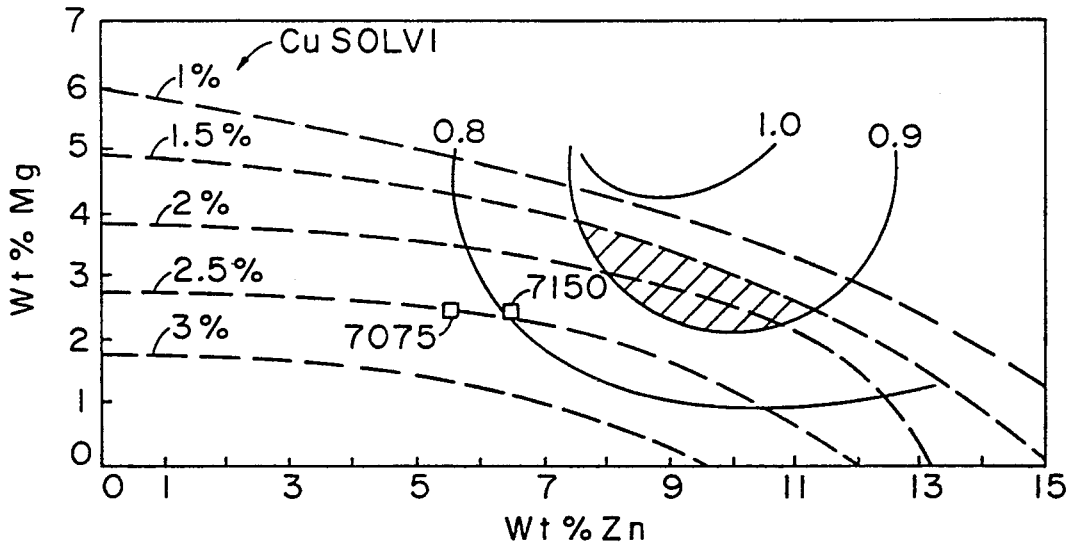
FIG. 4 shows part of an Al-Zn-Mg-Cu phase diagram for selecting the composition of the base alloy prior to Li additions.

FIG. 4 shows superimposed sections of iso-specific strength from experimental alloys containing 1.5 % Cu. This figure is used to select suitable Al-Zn-Cu-Mg compositions without constituent phases and at a given level of specific strength.

Specific strength, as used herein, is the tensile yield strength divided by the density of the alloy. Plate products, for example, made from alloys in accordance with the invention, have a specific strength of at least $0.75 \times 10^6$ ksi in$^3$/lb and preferably at least $0.80 \times 10^6$ ksi in$^3$/lb. The alloys have the capability of producing specific strengths as high as $1.00 \times 10^6$ ksi in$^3$/lb.

The wrought product in accordance with the invention can be provided either in a recrystallized grain structure form or an unrecrystallized grain structure form, depending on the type of thermomechanical processing used. When it is desired to have an unrecrystallized grain structure plate product, the alloy is hot rolled and solution heat treated, as mentioned earlier. If it is desired to provide a recrystallized plate product, then the Zr is kept to a very low level, e.g., less than 0.09 wt.%, and the thermomechanical processing is carried out at rolling temperatures of about 800° to 850° F. with the solution heat treatment as noted above. For unrecrystallized grain structure, Zr should be above 0.10 wt.% and the thermomechanical processing is as above except a heat-up rate of not greater than 5° F/min and preferably less than 1° F./min is used in solution heat treatment.

If recrystallized sheet is desired having low Zr, e.g., less than 0.1 wt.%, typically in the range of 0.05 to 0.08 Zr, the ingot is first hot rolled to slab gauge of about 2 to 5 inches as above. Thereafter, it is reheated to between 700 to 850° F. then hot rolled to sheet gauge. This is followed by an anneal at between 500 to 950° F. for 1 to 12 hours. The material is then cold rolled to provide at least a 25% reduction in thickness to provide a sheet product. The sheet is then solution heat treated, quenched stretched and aged as noted earlier. Where the Zr content is fairly substantial, such as about 0.12 wt.%, a recrystallized grain structure can be obtained if desired. Here, the ingot is hot rolled at a temperature in the range of 800° to 1000° F. and then annealed at a temperature of about 800° to 850° F. for about 4 to 16 hours. Thereafter, it is cold rolled to achieve a reduction of at least 25% in gauge. The sheet is then solution heat treated at a temperature in the range of 850 to 1020° F. using heat-up rates of not slower than about 10° F./min with typical heat-up rates being as fast as 200° F./min with faster heat-up rates giving finer recrystallized grain structure. The sheet may then be quenched, stretched and aged.

The alloy of the present invention is useful also for extrusions and forgings with improved levels of mechanical properties, for example. Extrusions and forgings are typically prepared by hot working at temperatures in the range of 500 to 1000° F., depending to some extent on the properties and microstructures desired.

While the invention has been described in terms of preferred embodiments, the claims appended hereto are intended to encompass other embodiments which fall within the spirit of the invention.

What is claimed is:

1. An aluminum base alloy suitable for forming into a wrought product having improved combinations of strength and fracture toughness, the product comprised of 0.6 to 3.0 wt.% Li, 0.5 to 3 wt.% Mg, 0.2 to 3 wt.% Cu, 5.1 to 12 wt.% Zn, 0.5 wt.% max. Fe, 0.5 wt.% max. Si, at least one of the elements selected from the group Cr, V, Hf, Mn, Ti, Ag, In and Zr, with Cr, V, Ti and Zr in the range of 0.01 to 1 wt.%; Hf and Mn up to 2 wt.% each, Ag in the range of 0.05 to 1 wt.% and In in the range of 0.01 to 0.5 wt.%, the balance aluminum and incidental impurities.

2. The alloy in accordance with claim 1 wherein Cu is in the range of 0.05 to 2.44.

3. The alloy in accordance with claim 1 wherein Cu is in the range of 0.2 to 2.4.

4. The alloy in accordance with claim 1 wherein Cu is in the range of 0.2 to 2.

5. The alloy in accordance with claim 1 wherein Mg is in the range of 0.5 to 2.5.

6. The alloy in accordance with claim 1 wherein Zn is in the range of 5.2 to 11.

7. The alloy in accordance with claim 1 wherein Zn is in the range of 5.5 to 11.

8. The alloy in accordance with claim 1 wherein Zn is in the range of 7.1 to 10.

9. The alloy in accordance with claim 1 wherein Zn is in the range of 7.2 to 10.

10. The alloy in accordance with claim 1 wherein Zn is in the range of 7.5 to 10.

11. The alloy in accordance with claim 1 wherein Zr is in the range of 0.01 to 0.5.

12. The alloy in accordance with claim 1 wherein Mn is 1 wt.% max.

13. An aluminum base alloy suitable for forming into a wrought product having improved combinations of strength and fracture toughness, the product comprised of 0.2 to 3.0 wt.% Li, 0.5 to 2.5 wt.% Mg, 0.2 to 2.4 wt.% Cu, 7.2 to 11 wt.% Zn, 0.5 wt.% max. Fe, 0.5 wt.% max. Si, at least one of the elements selected from the group Cr, V, Hf, Mh, Ti, Ag, In and Zr, with Cr, V, Ti and Zr in the range of 0.01 to 0.5 wt.%; Hf and Mn up to 1 wt.% each, Ag in the range of 0.05 to 1 and In in the range of 0.01 to 0.5, the balance aluminum and incidental impurities.

14. An aluminum base alloy suitable for forming into a wrought product having improved combinations of strength and fracture toughness, the product comprised of 0.2 to 3.0 wt.% Li, 0.1 to 3 wt.% Mg, 0.2 to 2 wt.% Cu, 7.5 to 10 wt.% Zn, 0.5 wt.% max. Fe, 0.5 wt.% max. Si, at least one of the elements selected from the group Cr, V, Hf, Mn, Ti, Ag, In and Zr, with Cr, V, Ti and Zr in the range of 0.01 to 0.2 wt.%; Hf and Mn up to 0.6 wt.% each, Ag in the range of 0.05 to 1 and In in the range of 0.01 to 0.5, the balance aluminum and incidental impurities.

* * * * *

UNITED STATES PATENT AND TRADEMARK OFFICE

CERTIFICATE OF CORRECTION

PATENT NO. : 5,135,713

DATED : August 4, 1992

INVENTOR(S) : Roberto J. Rioja and James T. Staley

It is certified that error appears in the above-identified patent and that said Letters Patent is hereby corrected as shown below:

| | |
|---|---|
| On title page, item [63], Related U.S. Application Data, line 5 | Change "March 19" to --March 29-- |
| Abstract, line 10 | After "and", insert --In-- |
| Col. 6, line 40 | Change "vin" to --Vin-- |
| Col. 12, line 2, Claim 13 | After "Hf", change "Mh" to --Mn-- |

Signed and Sealed this

Fourteenth Day of September, 1993

Bruce Lehman

*Attest:*

BRUCE LEHMAN

*Attesting Officer*

*Commissioner of Patents and Trademarks*